United States Patent [19]

Linder et al.

[11] Patent Number: 4,728,273

[45] Date of Patent: Mar. 1, 1988

[54] ROTARY PISTON COMPRESSOR

[75] Inventors: Ernst Linder, Mühlacker; Helmut Rembold, Stuttgart; Walter Teegen, Waiblingen, all of Fed. Rep. of Germany

[73] Assignee: Robert Bosch GmbH, Stuttgart, Fed. Rep. of Germany

[21] Appl. No.: 915,314

[22] Filed: Oct. 3, 1986

[30] Foreign Application Priority Data

Dec. 21, 1985 [DE] Fed. Rep. of Germany ..... 3545674

[51] Int. Cl.[4] ..... F01C 1/18; F01C 1/24

[52] U.S. Cl. ..... 418/206; 418/179

[58] Field of Search ..... 418/206, 152, 179, 201

[56] References Cited

U.S. PATENT DOCUMENTS

| | | | |
|---|---|---|---|
| 140,509 | 7/1873 | Knox | 418/206 |
| 2,014,932 | 9/1935 | Hallett | 418/179 |
| 2,457,314 | 12/1948 | Lysholm | 418/201 |
| 2,622,787 | 12/1952 | Nilsson | 418/202 |
| 3,112,867 | 12/1963 | Roberts | 418/206 |
| 3,178,104 | 4/1965 | Williams | 418/201 |
| 3,282,495 | 11/1966 | Walls | 418/201 |
| 4,492,540 | 1/1985 | Yamamoto | 418/152 |

*Primary Examiner*—Carlton R. Croyle
*Assistant Examiner*—Jane E. Obee
*Attorney, Agent, or Firm*—Michael J. Striker

[57] ABSTRACT

A rotary piston compressor, particularly Root's type compressor, includes a housing which is made of only two portions, one of which is cut-shaped and accommodates pistons rotating in opposite directions, and the other of which is formed as a cover closing the end face of the first portion. The two portions are connected to each other and positioned relative to each so that they abut each other along a separation plane which extends centrally of a suction connection and a pressure connection formed on the housing diametrically opposed relative to each other.

3 Claims, 4 Drawing Figures

ROTARY PISTON COMPRESSOR

BACKGROUND OF THE INVENTION

The present invention relates to a rotary piston compressor, and more specifically to a Root's type compressor.

Rotary piston compressors of the foregoing type include a housing with a suction connection and a pressure connection formed on the housing and two pistons positioned in the housing and rotated by a drive gear in the opposite directions. In such compressors the lemniscate-shaped pistons uniformly rotate in opposite directions. A gaseous conveying agent flows into the housing enclosing the pistons, through the suction connection and is forcibly conveyed in the chambers, formed by the housing and the pistons, to the pressure connection. When the head of each piston appears at the edge of the pressure connection the conveyed gas volumes become compressed by a return flow from the pressure connection. A compression pressure is adjusted in accordance with the resistance of the tubular conduits and the equipment connected to the compressor.

In conventional rotary piston compressors, the housing is formed of three portions which are a cylindrical intermediate portion and two side portions formed as covers closing the end faces of the intermediate portion. The intermediate portion accommodates the pistons. The suction connection and the pressure connection are formed radially at the center of the cylindrical intermediate portion. The drive shafts which rotate the pistons are supported in side housing portions by two-row taper ball bearings which are sealed in the compressor housing by slide ring sealings. The control drive gear formed of two meshing gears is accommodated in one of the housing side portions while one of the shafts extends through the other side portion outwardly to be connected to a drive.

The structure of the housing of the known compressor of the type under discussion is not very favorable in manufacture. Firstly it is not satisfactory because three parts of the housing must be manufactured precisely. Secondly, since the suction connection and the pressure connection must be positioned one against the other centrally on the cylindrical intermediate portion, a divided core mold must be provided for die cast manufacturing of the intermediate portion, which normally makes the use of the die cast machine quite expensive. Moreover, two-row taper ball bearings and slide ring sealings make the manufacture of such a compressor more costly. The producing of the components of cast iron results in a relatively heavy rotary piston compressor.

SUMMARY OF THE INVENTION

It is an object of the present invention to provide an improved rotary piston compressor.

It is another object of the invention to provide a rotary piston compressor in which a housing blank can be by about 40% less expensive than that of the conventional compressors.

These and other objects of the invention are attained by a rotary piston compressor, particularly Root's type compressor, comprising a housing having a suction connection and a pressure connection both formed on said housing; two rotary pistons positioned in said housing and rotating in two opposite directions; and a control drive for forcibly coupling a rotational movement of said two pistons, said housing being formed as a two-part element and including a cup-shaped first portion and a cover-shaped second portion closing said first portion, said first and second portions being connected to each other and positioned relative to each other so that they abut each other along a separation plane which extends through said suction and pressure connections.

The separation plane may extend approximately centrally of said suction and pressure connections.

The first and second housing portions may be formed of die cast aluminum.

The pistons may be formed of die cast aluminum.

The pistons each may have a shaft, said first portion having a bottom wall, each shaft being supported in said bottom wall and said second portion by means of grooved ball bearings.

The bearings may be sealed in said housing by retaining rings.

The control drive may be accommodated in the second housing portion.

The drive may be comprised of two meshing gears which are positioned on said shafts, respectively, for joint rotation therewith and which are made of die cast aluminum.

The fact that the housing is comprised of two portions reduces the number of components which are to be produced precisely. The formation of the suction and pressure connections as half-shells of which each half-shell belongs to a respective housing portion would enable the die cast manufacturing with the use of a one-part core mold, which would substantially simplify the cast machine to be used.

The manufacturing of the housing, rotary piston and the drive gear of die cast aluminum reduces weight of the compressor and offers the possibility of the application of the rotary piston compressors in motor vehicles. Grooved ball bearings and sealings formed as retaining rings further reduce manufacture costs.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
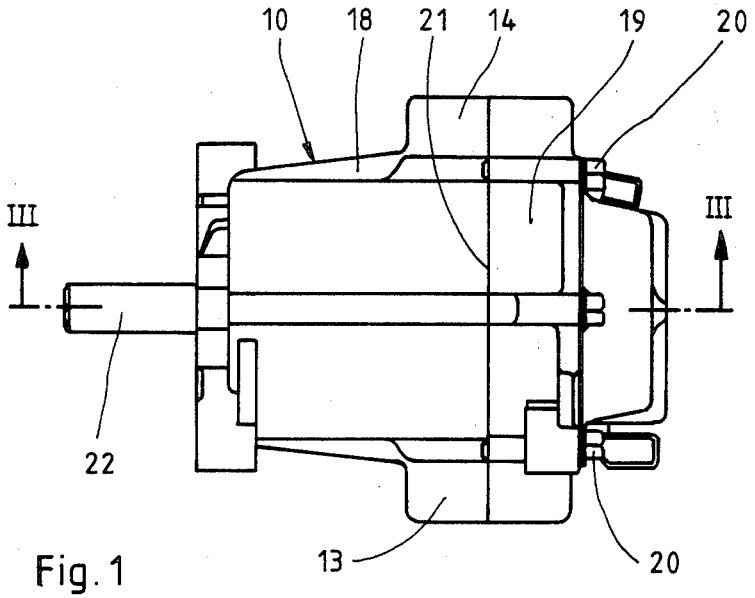
FIG. 1 is a side-view of the Root's type compressor of the invention.
Figure 2:
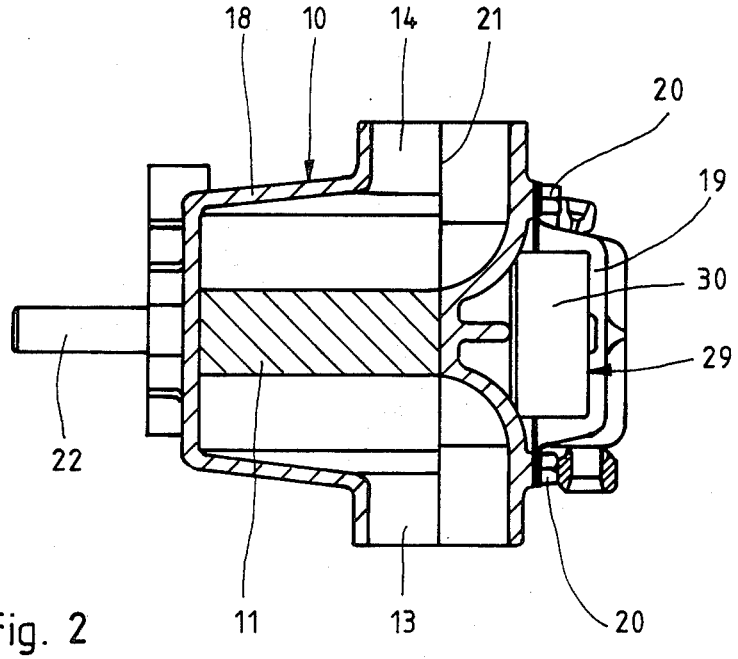
FIG. 2 is a longitudinal sectional view of the compressor of FIG. 1.
Figure 3:
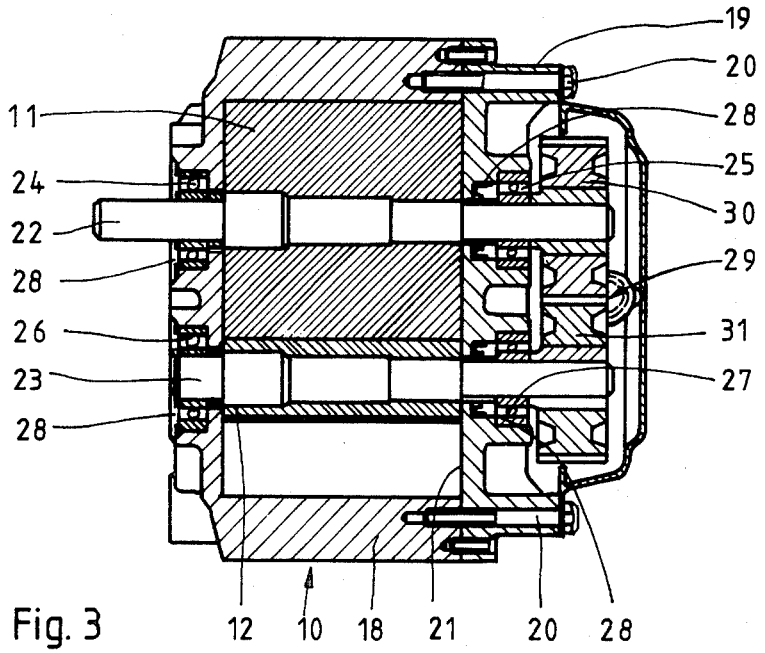
FIG. 3 is a sectional view taken along line III—III of FIG. 1.

Referring now to the drawings in detail it will be seen that the Root's type compressor, which is in the exemplified embodiment the rotary piston compressor, has a housing 10 which accommodates two rotary pistons 11 and 12 rotating in opposite directions. As seen from FIG. 2, at one side of the housing 10 is positioned a radially extending suction connection 13 whereas at the other side of the housing is positioned a radially projecting pressure connection 14 which is diametrically opposed to suction connection 13.

Figure 4:
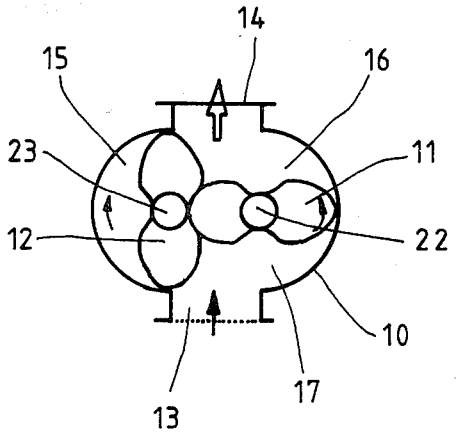
FIG. 4 is a schematic view of the Root's type compressor.

With reference to FIG. 4, which schematically shows a section of the rotary piston compressor of this invention, it will be seen that two pistons 11 and 12 rotate in opposite directions as shown by arrows. A gaseous conveying agent flows in the housing 10 through the suction connection 13 and is forcibly fed in chambers 15, 16, 17, formed by rotary pistons 11, 12 and housing 10, towards the pressure connection 14. At the moment at which the piston head passes the edge of the pressure connection 14 the gas volume conveyed by the piston is compressed by the return flow from the pressure connection 14.

Housing 10 is a two-part housing and is comprised of two housing portions 18 and 19. The first housing portion 18 is cup-shaped and receives both rotary pistons 11, 12 while the second housing portion 19 closes the housing portion 18 at the open end face thereof and is shaped as a cover. Both housing portions 18 and 19 are connected to each other by bolts 20. Housing portions 18 and 19 abut one another at a separation plane 21 which extends centrally of the suction connection 13 and pressure connection 14 so that the suction connection 13 and pressure connection 14 are each formed of two half-shells and one half shell of each connection is formed on the housing portion 18 whereas the other half shell of each connection is formed on the housing portion 19, as clearly shown in FIG. 2.

Both housing portions 18, 19 are manufactured of die cast aluminum.

Rotary pistons 11, 12, which are also formed of die cast aluminum, are positioned on shafts 22, 23, respectively for joint rotation therewith, on the one hand, and on the other hand, they are supported in housing 10 in two ball bearings 24, 25 and 26, 27. The ball bearings 24 and 26 are arranged respectively in the bottom wall of the cup-shaped housing portion 18 whereas ball bearings 25, 26 are positioned in the second housing portion 19. For sealing the shafts 22, 23 in the housing 10, sealing rings 28 are inserted or the housing.

Shaft 23 terminates at the bottom wall of the first housing portion 18 whereas shaft 22 extends through said bottom wall outwardly thereof for connection with a drive (not shown). Both shafts 22 and 23 are forcibly coupled in their rotational movement by a control drive gear 29 which is accommodated in the housing portion 19. The control drive gear 29 is comprised of two meshing gears 30 and 31 formed of die cast aluminum. Gears 30 and 31 are rotation-fixed on shafts 22 and 23, respectively.

It will be understood that each of the elements described above, or two or more togehter, may also find a useful application in other types of rotary piston compressors differing from the types described above.

While the invention has been illustrated and described as embodied in a rotary piston compressor, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A rotary piston compressor, particularly Root's type compressor, comprising a housing having a suction connection and a pressure connection both formed on said housing; two rotary pistons positioned in said housing and rotating in two opposite directions; and a control drive for forcibly coupling a rotational movement of said two pistons, said housing being formed as a two-part element and including only a cup-shaped first portion and a second portion closing said first portion; said suction and pressure connections being formed by said first and second portions which are connected to each other and positioned relative to each other so that they abut each other along a separation plane which extends centrally of said suction and pressure connection, said control drive being accommodated in said second portion, said drive including two meshing gears which are positioned on said shafts, respectively, for joint rotation therewith.

2. The compressor as defined in claim 1, wherein said pistons each has a shaft, said first portion having a bottom wall, each shaft being supported in said bottom wall and said second portion by means of ball bearings.

3. The compressor as defined in claim 1, wherein said bearings are sealed in said housing by sealing rings.

* * * * *